United States Patent [19]

Lerner et al.

[11] 4,076,598

[45] Feb. 28, 1978

[54] METHOD, ELECTROLYTE AND ADDITIVE FOR ELECTROPLATING A COBALT BRIGHTENED GOLD ALLOY

[75] Inventors: Lewis Brian Lerner, Linglestown; Thomas Francis Davis, Harrisburg, both of Pa.

[73] Assignee: AMP Incorporated, Harrisburg, Pa.

[21] Appl. No.: 742,955

[22] Filed: Nov. 17, 1976

[51] Int. Cl.[2] ..... C25D 3/62

[52] U.S. Cl. ..... 204/43 G; 204/DIG. 2; 252/182

[58] Field of Search ..... 204/43 G, 43 T, 46 G, 204/DIG. 2; 252/182

[56] References Cited

U.S. PATENT DOCUMENTS

| | | | |
|---|---|---|---|
| 3,149,057 | 9/1964 | Parker et al. | 204/46 G |
| 3,149,058 | 9/1964 | Parker et al. | 204/46 G |
| 3,475,292 | 10/1969 | Shoushanian | 204/44 |

FOREIGN PATENT DOCUMENTS

| | | | |
|---|---|---|---|
| 1,262,723 | 3/1968 | Germany | 204/43 G |
| 1,446,043 | 4/1969 | Germany | 204/43 G |

*Primary Examiner*—G. L. Kaplan
*Attorney, Agent, or Firm*—Russell J. Egan

[57] ABSTRACT

Disclosed are methods and electrolytes for the electrodeposition of a gold alloy containing 0.05 to 0.4 per cent by weight of cobalt. The electrolytes comprise aqueous acidic solutions containing nitrilotriacetic acid.

13 Claims, No Drawings

METHOD, ELECTROLYTE AND ADDITIVE FOR ELECTROPLATING A COBALT BRIGHTENED GOLD ALLOY

BACKGROUND OF THE INVENTION

Plating gold by electrodeposition employing as a gold plating bath a gold cyanide has been well known and used in combination with different electrolytes. Wherever additives to gold have been employed, these have been rendered soluble in the electrolyte and various metals have been sought to be incorporated in gold with diverse results in the end product achieved by electrodeposition. Variations of results because of bath compositions have also been observed. In general, electrodeposition of gold and cobalt on suitable substrates has been associated with jewelry making. However, entirely different requirements are needed for functional deposits such as used in electronic industry, e.g., for contact devices.

BRIEF DESCRIPTION OF THE PRIOR ART

Of the various methods used for depositing gold-cobalt alloys and known in the art, those most commonly employing various organic electrolytes as well as cobalt chelating agents are known. For example, in U.S. Pat. No. 3,149,057 a cobalt chelate of ethylene diamine tetraacetic acid has been used. In U.S. Pat. No. 3,905,601, acetic acid and sodium acetate have been used as an electrolyte, with gold being added as a cyanide and cobalt as sulfate. Various mixtures of different gold alloys have been disclosed, but the gold alloys are generally ternary alloys, employing as electrolyte, a diverse combination of salts.

Still further, in U.S. Pat. No. 2,812,299, gold in combination with various other alloying components has been disclosed as being deposited from a bath at a pH of 6.5 to 7.5 using the alloying metal in the form such as potassium nickel cyanide. Still further, in U.S. Pat. No. 3,856,638, a bright gold electroplating bath has been disclosed using an alkali metal gold cyanide and as an alloying agent, cobalt in the form of a complex with amino guanidine and as a complexing agent, amino trimethylene phosphonic acid (ATMPA) or ethylene diamine tetramethylene phosphonic acid (EDMPA). A fairly extensive discussion of the prior art is also found in the last mentioned patent.

Still further, in U.S. Pat. No. 3,902,977, a co-deposit of gold and a metal such as indium, cobalt, or nickel have been disclosed using a chelate of ethylene diamine tetraacetic acid or iminodiacetic acid. Still further, the discussion of the prior art in this patent is of interest because of the summary found of the various shortcomings experienced by the prior art practitioners. In this patent, a fairly complex combination of electrolytes and additives therefor have been disclosed generally producing a co-deposit of various metals from the bath solution.

In U.S. Pat. No. 3,716,463, an electrolyte for a gold cyanide bath and comprising of citric acid, potassium citrate, and as an additive cyclohexyl amine has been disclosed as being suitable for depositing a bright and stress free deposit of gold and cobalt supposedly attributable to cyclohexyl amine.

DESCRIPTION OF THE PRESENT INVENTION AND EMBODIMENTS THEREOF

It has now been found that a plating bath containing a complexing agent for controlling the amount of cobalt deposited in the gold cobalt alloy produces gold cobalt alloys of excellently controllable properties such as with respect to the amount of cobalt in the deposit, hardness, wearability, such as in use in electrical contacts, of very good stress properties and excellent initial contact resistance as well as very good contact resistance after wearability tests over a broad current density range at high efficiencies. Thus, these properties have been obtained over a wide spectrum of current density ranges such as from 1 to 100 ASF (amperes per square foot) at an efficiency which has been found to be outstanding. Still further, the deposits have been obtained at high current density without the high stresses encountered with some of the prior art baths. As a consequence of the many benefits, the deposition is easy to control over a wide current density range.

The bath is generally operated at a temperature from 80° to 150° F, preferably from 90° to 120° F, and most desirably from 100° to 110° F. The pH of the bath solution may range from 3.5 or 3.6 to 6, a narrower range is from 4.0 to 6.0, with the optimum at about a pH of 4.3. In distinction from the various prior art baths used for depositing gold-cobalt alloys or other ternary deposits, the present bath displays excellent control of cobalt deposition as a percent of gold over the current density ranges indicated above and especially at current densities from 1 to 50 ASF.

With respect to the amount of cobalt added to the bath, it may range from 0.1 to 7 grams per liter of bath solution as elemental cobalt, but added as a bath soluble cobalt salt such as cobalt sulfate, e.g., heptahydrate, cobalt carbonate, cobalt nitrate, cobalt chloride, etc. As an additive for apparently contributing to the excellent control for obtaining the precise amounts of cobalt being added to the gold deposit (depending upon the concentration of cobalt in the bath), nitrilotriacetic acid in a concentration from 3 to 60 grams per liter of bath solution has been used with great success. When operating the bath at a lower current density such as a current density from 1 to 15, it has been found that the concentration of nitrilotriacetic acid is best used in the amount from 3.0 to 30 grams per liter and cobalt in the amount from 0.1 to 2.0 grams per liter on elemental basis added as a cobalt sulfate heptahydrate. It is postulated that the improved results are attributable to the formation of a complex of cobalt with nitrilotriacetic acid in the bath solutions described herein. Hence, the formed complex may be suitable for depositing cobalt with gold from other baths in which this complex is soluble.

As the preferred electrolyte, tripotassium citrate monohydrate has been used also in combination with potassium dihydrogen phosphate in amounts from 50 to 150 grams per liter and 50 to 200 grams per liter of bath solution, respectively. These electrolytes not only buffer in a more stable manner the bath solution, but do not introduce unwanted contaminants. Although other sulfates and phosphates may also be used as electrolytes, the previously mentioned potassium phosphates and citrate are vastly more desirable.

As another combination. but also desirable and providing less superior results, a combination of 50 to 100 grams per liter of potassium dihydrogen phosphate and 50 to 100 grams per liter of bath solution of dipotassium hydrogen phosphate has been used. When using the last two electrolytes, the amount of nitrilotriacetic may range from 3.0 to 30 grams per liter and cobalt from 0.1 to 5 grams per liter of bath solution as elemental cobalt and added as cobalt sulfate heptahydrate to the bath. Still further, for the last mentioned bath, the amount of gold added as potassium gold cyanide ($KAu(CN)_2$) is used in an amount from 1.0 to 2.0 troy ounces per gallon of bath solution, based on elemental gold.

As suitable anodes, the following are useful: platinum, platinum clad tantalum, platinum plated titanium. For pH adjustment, citric acid or potassium hydroxide may be used.

With respect to the first mentioned potassium dihydrogen phosphate and tripotassium citrate monohydrate, gold is generally added as potassium gold cyanide in the amount from 1.0 to 4.0 troy ounces per gallon of bath solution expressed as elemental gold. The deposits which are obtained range from a deposit wherein the cobalt is from 0.05 to 0.4 percent based on weight gold of a Knoop hardness ranging from 130 to 200 (at 25 gram load).

The plating rate in accordance with the above invention generally is at 15 to 70 microinches per minute. The efficiency is 50 to 65 percent, which is considered very good for the preferred plating bath solution.

With respect to the enclosed examples, these illustrate the embodiments of the invention in various aspects thereof. These are merely illustrations without intending to limit the invention.

EXAMPLE 1

The following compositon was used in plating cobalt-gold compositions of various amounts of cobalt in the deposit ranging from 0.05 to 0.4 percent based on cobalt in the deposit; plating was carried out at the indicated conditions in an aqueous bath of the following composition:

2 troy oz/gal Au° (added as $KAu(CN)_2$);
60 g/l $K_3$ citrate;
60 g/l $KH_2PO_4$;
22 g/l nitrilotriacetic acid; and
1.5 g/l Co°, added as $CoSO_4.7H_2O$.
pH 4.3
Operating temperature = 110° F
Current density = 1 - 100 ASF.

In accordance with the method described above, depositions were made on electrical contact devices such as AMP-CHAMP(R) terminals, pin and socket terminals, and, in general, copper and copper alloy terminals such as beryllium copper. When tested for the various properties, these platings are found to meet all the requirements for good platings.

EXAMPLE 2

In accordance with the above procedure, but operating at a lower current density range, the following electrolyte composition was found to be acceptable for bath solution from which various gold plating compositions wherein cobalt ranged from 0.05 to 0.4 percent were made, with plating carried out at the indicated conditions in an aqueous bath of:

1 troy oz/gal Au° (added as $KAu(CN)_2$);
60 g/l $KH_2PO_4$;
60 g/l $K_3$ citrate;
7.5 g/l nitrilotriacetic acid; and
0.5 g/l Co°, added as $CoSO_4.7H_2O$;
pH - 4.8
Operating temperature = 100° F
Current density = 1 - 30 ASF.

EXAMPLE 3

When practicing the invention as described in Example 2, equally acceptable results were obtained when varying the conditions as follows:

1.0 - 4.0 troy oz/gal Au° as elemental gold (added as $KAu(CN)_2$)
3.0 - 30 g/l nitrilotriacetic acid
50 - 100 g/l $K_3$ citrate
0.1 - 2.0 g/l Co° added as cobalt sulfate;
pH adjusted with citric acid to 4.0 - 5.0

The disclosed plating compositions have produced a bright, hard gold-cobalt alloy at high efficiency and operable over an extended current density range.

When tested in electrical contact devices for hardness, stress, wearability, initial and cycled contact resistance (indicating galling, porosity, oxidation of substrate, etc.), the deposits obtained from the herein disclosed bath displayed good properties.

What is claimed is:

1. An aqueous bath for depositing from an electrolyzed solution thereof gold and, as an alloying additive to gold, variously closely controllable amounts of cobalt in an amount from 0.05 to 0.4 in percent by weight in the deposit based on amount of gold, said bath solution consisting essentially of:

1.0 - 4.0 troy oz/gal Au°, added as $KAu(CN)_2$;
50 - 150 g/l $K_2HPO_4$;
50 - 200 g/l $KH_2PO_4$;
5 - 60 g/l nitrilotriacetic acid; and
0.1 - 7.0 g/l Co°, as a soluble salt of cobalt, from at least one salt selected from the group consisting of cobalt sulfate, halide, nitrate and carbonate, said bath having a pH of 4.0 to 6.0.

2. The bath as defined in claim 1 wherein the soluble salt of cobalt is cobalt sulfate.

3. A salt composition suitable for depositing gold and cobalt from an electrolyzed aqueous bath solution thereof, said composition consisting essentially of the salts as defined in claim 1, in the proportions thereof.

4. An aqueous bath for depositing from an electrolyzed solution thereof gold and, as an alloying additive to gold, variously closely controllable amounts of cobalt in an amount from 0.05 to 0.4 in percent by weight in the deposit based on amount of gold, said aqueous bath solution consisting essentially of:

1.0 - 4.0 troy oz/gal Au°, added as $KAu(CN)_2$;
50 - 100 g/l $KH_2PO_4$;
50 - 100 g/l $K_3$ citrate;
5 - 30 g/l nitrilotriacetic acid; and
0.1 - 2.0 g/l Co° added as a bath soluble salt of cobalt, from at least one salt selected from the group consisting of cobalt sulfate, nitrate, chloride, carbonate, and mixtures of same, said bath having a pH of 3.5 to 6.0.

5. The bath as defined in claim 4, wherein the soluble salt of cobalt is cobalt sulfate.

6. A salt composition suitable for depositing gold and cobalt from an electrolyzed aqueous bath solution said composition consisting essentially in the proportions, when added to water, of gold as potassium gold cyanide 1.0 to 4.0 troy oz/gal, calculated as elemental gold; potassium dihydrogen phosphate, 50 to 100 grams/liter; tripotassium citrate, 50 to 100 grams/liter; nitrilotriacetate acid, 5 to 30 grams/liter; and as a cobalt salt, 0.1 to 2.0 grams/liter of cobalt; selected from the group consisting of cobalt sulfate, chloride, nitrate, carbonate and mixtures of same.

7. A method for deposition from an electrolyzed aqueous bath solution gold cobalt alloys, the steps comprising:

electrolyzing a bath solution of:

1.0 - 4.0 troy oz/gal Au°, added as $KAu(CN)_2$;

50 - 150 g/l $K_2HPO_4$;

50 - 200 g/l $KH_2PO_4$;

5 - 60 g/l nitrilotriacetic acid; and 0.1 - 7.0 g/l Co° added as a bath soluble salt of cobalt sulfate, nitrate, chloride, or carbonate; wherein the solution is at a pH of 3.6 to 6.0 and at a temperature from 80° F to 150° F;

passing a current between a cathode and an anode, wherein the current density ranges from 1 to 100 ASF; and depositing a gold-cobalt on a substrate of closely controllable proportions of gold to cobalt in said deposit.

8. The method as defined in claim 7, wherein the cobalt salt is cobalt sulfate.

9. The method as defined in claim 7, wherein the pH of the bath is of about 4.2, the temperature of about 110° F, and current density from 1 to 50 ASF.

10. A method for depositing from an electrolyzed aqueous bath solution gold-cobalt alloys, the steps comprising:

electrolyzing a bath solution of 1.0 - 4.0 troy oz/gal Au°, added as $KAu(CN)_2$;

50 - 100 g/l $KH_2PO_4$;

50 - 100 g/l $K_3$ citrate;

10 - 30 g/l nitrilotriacetic acid; and 0.1 - 2.0 g/l Co° added as a bath soluble cobalt salt; wherein the solution is at a pH of 3.6 to 6.0 and a temperature from 80° F to 150° F, passing a current between a cathode and an anode, whereby the current density ranges from 1 to 100 ASF; and depositing on a substrate a deposit of closely controllable proportions of gold to cobalt in said deposit.

11. The method as defined in claim 10, wherein the pH of the bath is about 4.2, the temperature about 100° F, and the current density of 1 to 50 ASF.

12. An aqueous bath for depositing from an elctrolyzed solution thereof gold and, as an alloying additive to gold, variously closely controllable amounts of cobalt, in an amount of 0.05 to 0.4 in percent by weight in the gold deposit, said aqueous solution consisting essentially of:

1.0 - 4.0 troy oz/gal Au° as elemental gold (added as $KAu(CN)_2$;

3.0 - 100 g/l nitrilotriacetic acid;

50 - 100 g/l $K_3$ citrate;

0.1 - 2.0 g/l Co°, added as cobalt sulfate, and, for pH adjustment, citric acid, said bath having pH of 4.0 to 5.0.

13. A salt composition suitable for depositing gold and cobalt from an electrolyzed aqueous bath solution thereof said composition consisting essentially of, in the proportions, when added to water, gold as potassium gold cyanide 1.0 to 4.0 troy oz/gal, calculated as elemental gold, tripotassium citrate 50 to 100 grams/liter, nitrilotriacetic acid 3.0 to 100 grams/liter and 0.1 to 2.0 grams/liter of cobalt, as a cobalt salt, selected from the group consisting of cobalt sulfate, chloride, nitrate, carbonate, and mixtures of same.

* * * * *